US006106910A

United States Patent [19]

Tan et al.

[11] Patent Number: 6,106,910

[45] Date of Patent: Aug. 22, 2000

[54] PRINT MEDIA WITH NEAR INFRARED FLUORESCENT SENSE MARK AND PRINTER THEREFOR

[75] Inventors: Yaoping Tan, Miamisburg; Maurice W. Lewis, Dayton; Bernard J. Jergens, Centerville, all of Ohio

[73] Assignee: NCR Corporation, Dayton, Ohio

[21] Appl. No.: 09/153,588

[22] Filed: Sep. 15, 1998

Related U.S. Application Data

[63] Continuation-in-part of application No. 09/107,362, Jun. 30, 1998, abandoned.

[51] Int. Cl.[7] ..... B41M 5/00; B41M 5/26

[52] U.S. Cl. ..... 428/29; 346/135.1; 428/211; 428/341; 428/342; 428/913; 503/206

[58] Field of Search ..... 428/195, 690, 428/211, 341, 342, 913; 503/206; 346/135.1

[56] References Cited

U.S. PATENT DOCUMENTS

| | | | |
|---|---|---|---|
| 4,150,997 | 4/1979 | Hayes | 106/15.05 |
| 4,153,593 | 5/1979 | Zabiak et al. | 260/29.6 ME |
| 4,288,701 | 9/1981 | Hill | 250/569 |
| 4,328,332 | 5/1982 | Hayes et al. | 528/296 |
| 4,370,370 | 1/1983 | Iwata et al. | 428/40 |
| 4,388,362 | 6/1983 | Iwata et al. | 428/211 |
| 4,424,245 | 1/1984 | Maruta et al. | 428/40 |
| 4,444,819 | 4/1984 | Maruta et al. | 503/209 |
| 4,507,669 | 3/1985 | Sakamoto et al. | 503/207 |
| 4,551,738 | 11/1985 | Maruta et al. | 503/200 |
| 4,598,205 | 7/1986 | Kaule et al. | 250/458.1 |
| 4,682,194 | 7/1987 | Usami et al. | 503/215 |
| 4,722,921 | 2/1988 | Kiritani et al. | 503/207 |
| 4,742,043 | 5/1988 | Tanaka et al. | 503/213 |
| 4,783,493 | 11/1988 | Motegi et al. | 524/13 |
| 4,942,150 | 7/1990 | Usami et al. | 503/213 |
| 5,106,998 | 4/1992 | Tanaka et al. | 549/331 |
| 5,155,230 | 10/1992 | Hibino et al. | 548/409 |
| 5,177,218 | 1/1993 | Fischer et al. | 549/25 |
| 5,206,395 | 4/1993 | Fischer et al. | 552/201 |
| 5,266,447 | 11/1993 | Takahashi et al. | 430/345 |
| 5,292,855 | 3/1994 | Krutak et al. | 528/289 |
| 5,336,714 | 8/1994 | Krutak et al. | 524/608 |
| 5,384,077 | 1/1995 | Knowles | 252/586 |
| 5,397,819 | 3/1995 | Krutak et al. | 524/88 |
| 5,405,958 | 4/1995 | VanGemert | 544/71 |
| 5,423,423 | 6/1995 | Sato et al. | 209/577 |
| 5,429,774 | 7/1995 | Kumar | 252/586 |
| 5,446,151 | 8/1995 | Rickwood et al. | 544/71 |
| 5,461,136 | 10/1995 | Krutak et al. | 528/289 |
| 5,614,008 | 3/1997 | Escano et al. | 106/23 D |
| 5,665,151 | 9/1997 | Escano et al. | 106/31.15 |
| 5,682,103 | 10/1997 | Burrell | 324/642 |
| 5,703,229 | 12/1997 | Krutak et al. | 540/140 |

FOREIGN PATENT DOCUMENTS

| | | | |
|---|---|---|---|
| 0085157 | 8/1983 | European Pat. Off. . | |
| 0595583 | 5/1994 | European Pat. Off. . | |
| 0608118 | 7/1994 | European Pat. Off. . | |
| 0679522 | 11/1995 | European Pat. Off. . | |
| 0719654 | 7/1996 | European Pat. Off. . | |
| 04001878A | 1/1992 | Japan | 428/195 |
| 9732733 | 9/1997 | WIPO . | |

OTHER PUBLICATIONS

U.S. Patent Application Serial No. 09/108,133, filed Jun. 30, 1998, entitled "Flexographic Security Ink with Near Infrared Fluorophores", by inventor Yaoping Tan et al., assigned to NCR Corporation.

U.S. Patent Application Serial No. 09/107,361, filed Jun. 30, 1998, entitled "Thermal Paper with Security Features", by inventor Yaoping Tan et al., assigned to NCR Corporation.

*Primary Examiner*—Bruce H. Hess
*Attorney, Agent, or Firm*—Millen White Zelano & Branigan

[57] ABSTRACT

A print medium having a sense mark comprised of a near infrared fluorescent component which triggers automated operations without interference from printed text or images or the substrate. The near infrared fluorescent pigments are protected from contact with oxygen using a polymer resin. Apparatus for dispensing printed media comprises a print medium of this invention, detector for sensing the mark, a logic element for locating the mark and a paper transporting apparatus controlled by the logic element. The apparatus can be incorporated in business machines such as automatic teller machines, cash registers, ticket dispensing machines and coupon dispensing machines.

27 Claims, 2 Drawing Sheets

PRINT MEDIA WITH NEAR INFRARED FLUORESCENT SENSE MARK AND PRINTER THEREFOR

CROSS-REFERENCE TO RELATED APPLICATION

This application is a continuation-in-part of Ser. No. 09/107,362, filed Jun. 30, 1998, which is hereby incorporated by reference, now abandoned.

BACKGROUND OF THE INVENTION

The invention relates to print media with a near infrared sense mark and apparatus which employ them. The near infrared sense mark triggers an automated operation such as printing, advancing, cutting and/or dispensing a print medium. Particular embodiments include print media and apparatus for point-of-sale transactions such as cash registers, automated teller machines and other receipt generating equipment.

Conventional business machines such as cash registers, ticket dispensers and automatic teller machines typically employ sense marks in dispensing printed media. This typically includes printing, advancing, cutting and stopping the print medium. Black colored marks are the most commonly used sense marks employed in business machines for dispensing printed media. One major disadvantage of using black sense marks is that the area between the sense marks must be clear for proper processing. This greatly reduces the area available for commercial, advertising and promotional printings. Although this overall technology is quite reliable, some sporadic problems do result when thermal papers are used. The thermal dyes on the thermal papers between sense marks can be prematurely activated and darkened during handling, storing or processing, causing a malfunction in the automatic operation of the business machine.

Replacing the black sense marks with other types of marks has not been successful. Use of other colors has resulted in either lower reliability or high cost. Similarly, the use of transparent marks that fluoresce when exposed to UV light has resulted in low reliability due to background interference from the substrate (paper) which contains UV absorbing and/or fluorescing compositions. This minimizes the contrast between the mark and the base sheet.

Near infrared fluorescent (NIRF) compounds have been used for marking articles for identification/authentication purposes Examples include U.S. Pat. No. 5,292,855, issued Mar. 8, 1994, U.S. Pat. No. 5,423,432, issued Jun. 13, 1995; U.S. Pat. No. 5,336,714, issued Aug. 8, 1994; and U.S. Pat. No. 5,703,229. issued Dec. 30, 1997, to Krutak et al. Other examples include U.S. Pat. No. 5,614,008, issued Mar. 25, 1997, to Escano et al.; and U.S. Pat. No. 5,665,151, issued Sep. 9, 1997.

The use of NIRF compounds is complicated by the fact that they are generally not stable in air. Krutak et al. disclose incorporating the NIRF compounds in carrier polymers and incorporating NIRF compounds in copolymers to protect the NIRF compounds from oxidation (see U.S. Pat. Nos. 5,292,855 and 5,703,229).

U.S. Pat. No. 5,682,103, issued to Burrell on Oct. 27, 1997, discloses an apparatus and method for checking the authenticity of security documents, wherein near infrared or visible waves are emitted and directed to the document. A detector detects any emitted near infrared or visible waves reflected from the document. This method and apparatus detects electromagnetic particles such as stainless steel fibers within the base material of a document to determine its authenticity.

Inks with photochromic or fluorescent pigments and layers which fluoresce or change color when exposed to a light source other than ambient light are typically referred to as optically variable inks. Such inks are used to provide latent images as a security feature. These optically variable inks allow for non-destructive testing of the security feature, allowing the printing of such inks to be monitored. Such optically variable inks typically respond to infrared or ultraviolet light. An example of an aqueous printing ink for jet printing which fluoresces under ultraviolet radiation is described in U.S. Pat. No. 4,153,593. The dyes described in this reference are water soluble and include fluorescein, eosine dyes and Rhodamine dyes. Representative disclosures of other inks include U.S. Pat. No. 4,328,332, issued to Hayes et al. on May 4, 1982, and U.S. Pat. No. 4,150,997, issued to Hayes on Apr. 24, 1979.

Unlike marks used as security features, a sense mark defines a location on the print media to trigger an automatic operation. To accomplish this, the sense mark must not only achieve a threshold emission such that it is sensed by a photon detector, it must achieve sufficient contrast with the base substrate such that its location can be identified by a logic apparatus via signals from the photon detector. Security features do not require such a level of contrast with the base sheet. The security marks need only be sensed for a pass/fail test. While interference with the base sheet for a security mark cannot be ignored, the location of the mark is typically irrelevant, such as where the NIRF compound is incorporated in the base sheet or is incorporated in the printed matter itself.

Many business machines operate with thermal paper. The use of direct thermal paper complicates the availability of a sense mark. Direct thermal paper is a thermosensitive recording material upon which print or a design is obtained by the application of heat energy, without an ink ribbon. Direct thermal paper comprises a base sheet and a coating. A major distinction in thermal paper from other coated papers is that special color forming chemicals and additives are present in the coatings such that, when heat is applied by a thermal head, the color forming chemicals react to develop the desired print or image.

The most common type of thermal coating is that of a dye-developing type system. The three main color producing components in a dye-developing-type thermal paper are colorless dye (color former), a biphenol or an acidic material (color developer) and sensitizer. These solid materials are reduced to very small particles by grinding and are incorporated into a coating formulation along with any optional additives such as pigments, binders and lubricants. This coating formulation is then applied to the surface of a base sheet or other support system and dried.

Where security features or sense mark is desired for thermal paper, the inks must not pre-react the reactive components within the thermal sensitive coating of the thermal paper to detract from the thermal papers printing performance. Certain chemical factors can adversely affect and degrade the performance of the thermosensitive coating and should be avoided such as some organic solvents (ketones), plasticizers (polyethylene glycol-type), amines (ammonia) and certain oils (soy oil). The coating solutions for NIRF compounds typically contain amines and other compounds, which the thermosensitive coatings react with.

To protect thermal paper from environmental conditions and premature coloration from handling, a number of developments have been made. One is to produce a barrier or protection layer on top of the thermal coating (see U.S. Pat. Nos. 4,370,370; 4,388,362; 4,424,245; 4,444,819; 4,507,669; and 4,551,738). Another approach is to encapsulate the reactive components and microcapsules which rupture or are permeable when exposed to heat. See U.S. Pat. Nos. 4,682,194; 4,722,921; 4,742,043; 4,783,493; and 4,942,150. These protection measures are not reliable in preventing premature coloration of the thermosensitive layer when exposed to a NIRF coloring solution.

SUMMARY OF THE INVENTION

It is an object of the present invention to provide a print medium with a NIRF sense mark which is reliable and stable.

It is another object of the present invention to provide a direct thermal paper with a NIRF sense mark which is reliable, stable and does not pre-react the reactive components in the thermosensitive coating of the direct thermal paper.

It is an additional object of the present invention to provide an apparatus which automatically dispenses printed media via detection of a NIRF sense mark on the printed media.

It is another object of the present invention to provide a printer which automatically handles direct thermal paper which employs a NIRF sense mark on direct thermal paper to trigger automated operations.

It is a further object of present invention to provide thermal paper for cash register receipts and ATM receipts with a NIRF sense mark.

Further objects and advantages of this invention will be apparent and further understood from the detailed description and claims which follow.

The above objects arc achieved through a print medium which comprises a base sheet and at least one mark on the surface of said base sheet positioned to trigger an automated operation when identified by a logic element (apparatus or circuit) typically via a signal from a detector. The mark comprises a near infrared fluorescent (NIRF) compound which reflects light in the near infrared region when illuminated with near infrared radiation. The concentration of NIRF compounds in the sense mark is sufficient to increase the reflectance of near infrared radiation of said mark above that of the base sheet. The area of the sense mark and the contrast in reflecting near infrared radiation between the sense mark and base sheet are sufficient such that the mark is sensed by a detector operating in the near infrared region of 600 nm to 2,500 nm and the location of the mark is identified by a logic element by one or more signals from the detector. The NIRF compounds are shielded from oxygen in ambient air so as not to react therewith. In preferred embodiments, the print medium is a thermal paper and the NIRF compounds (and their carriers) are selected so as not to prereact the thermosensitive coating on the thermal papers. Preferred NIRF compounds reflect radiation at a wavelength of about 780 nm and above. These compounds experience less interference with the base substrate.

In another aspect of the present invention, there is provided an apparatus for automatic dispensing of printed media which comprises a print medium comprising a base sheet with a sense mark comprising a near infrared fluorescent (NIRF) compound in an amount sufficient to increase the reflectance of near infrared radiation of the sense mark over the surface of the base sheet. The area of said mark and the contrast in reflecting infrared radiation between said mark and base sheet are sufficient such that the mark is sensed by a detector operating in the near infrared region of 600 nm to 2,500 nm and the location of the mark is identified by a logic apparatus via signals from the detector. The apparatus additionally comprises a detector for sensing the mark and generating a signal, a logic element for locating the mark based on the signal from the detector and a paper transporting apparatus controlled by the logic element.

DETAILED DESCRIPTION

The print media of the present invention comprise a base sheet. The base sheet can comprise a conventional paper suitable for printing either by impact, ink jet, laser, flexographic, thermal transfer, electrostatic or thermal printing. The paper can be coated or uncoated to modify performance such as the absorption of inks or, as in the case of thermal paper, to provide reactive elements that generate color upon the application of heat. Base sheets for thermal printing include those having protective layers which prevent discoloration during handling. Suitable base sheets can comprise natural or synthetic fibers or both, and are either filled or unfilled with pigments such as titanium dioxide.

The base sheet is preferably a thermal paper having at least one surface coated with a thermosensitive coating. The thermosensitive coatings are preferably of the dye developing type. Particularly suitable dye developer systems are those wherein the reactive dyes are colorless or white-colored, which become dark colored when melted and exposed to a color developer. Such dyes are typically basic substances which become colored when oxidized by bisphenol and other acidic compounds. In these dye developer systems, sensitizers are typically mixed with the dyes to form a blend with a reduced melting point. This reduces the amount of heat necessary to melt the dye and obtain reaction with the color developer. The components of the thermosensitive coating are often determined by the operating temperature of the thermal printer to be used. The operating temperature of conventional thermal printers varies widely, typically within the range of from 50 to 250° C. One skilled in the art can readily determine the melting point necessary for a desired application and select a dye and developer accordingly or select a conventional thermal paper with a thermosensitive coating on one side. A preferred color developer is bisphenol A and a preferred sensitizer is M-terphenol. Leuco dyes are typically used as color formers in thermosensitive recording materials such as thermal paper. Leuco dyes are colorless or light colored basic substances which become colored when oxidized by acidic substances. Examples of leuco dyes that can be used herein are described as follows:

a) leuco bases of triphenylmethane dyes represented by formula I:

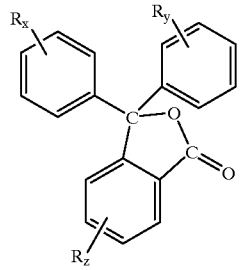

wherein $R_x$, $R_y$, and $R_z$ of general formula I can be, independently of each other, hydrogen, hydroxyl, halogen, $C_1$–$C_6$ alkyl, nitro or aryl Specific examples of such dyes are: 3,3-bis(p-dimethylaminophenyl)-phthalide, 3,3-bis(p-dimethylaminophenyl)-6-dimethylaminophthalide (Crystal Violet Lactone), 3,3-bis(p-dimethylaminophenyl)-6-diethylaminophthalide, 3,3-bis(p-dimethylaminophenyl)-6-chlorophthalide, and 3,3-bis(p-dibutylaminophenyl)-phatalide.

(b) Leuco bases of fluoran dyes represented by formula II:

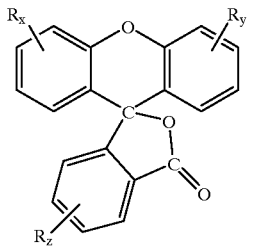

wherein $R_x$, $R_y$, and $R_z$ of formula II are as defined above for formula I. Some examples are: 3-cyclohexylamino-6-chlorofluoran, 3-(N-N-diethylamino)-5-methyl-7-(N,N-dibenzylamino)fluoran, 3-dimethylamino-5,7-dimethylfluoran and 3-diethylamino-7-methylfluoran.

(c) Other suitable fluoran dyes include: 3-diethylamino-6-methyl-7-chlorofluoran, 3-pyrrolidino-6-methyl-7-anilinofluoran, and 2-[3,6-bis(diethylamino)-9-(0-chloroanilino)xanthybenzoic acid lactam].

(d) Lactone compounds represented by formula III:

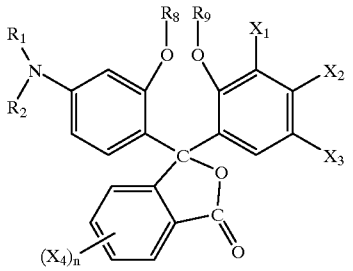

wherein $R_1$ and $R_2$ of formula III, independently of each other, represent hydrogen, unsubstituted $C_1$–$C_6$ alkyl, substituted $C_1$–$C_6$ alkyl, substituted phenyl, unsubstituted phenyl, cyanoethyl, -halogenated ethyl, or $R_1$ and $R_2$ in combination form a cyclic structure and represent —$(CH_2$—$)_4$, (—$CH_2$—$)_5$ and at least one of $R_8$ and $R_9$ is hydrogen and the other is hydrogen, $C_1$–$C_6$ alkyl, aralkyl, amyl, or phenyl; $X_1$, $X_2$ and $X_3$ each, independently of each other, represent hydrogen, $C_1$–$C_6$ alkyl, halogen, halogenated methyl, nitro, amino or substituted amino and $X_4$ represents hydrogen, $C_1$–$C_6$ alkyl or $C_1$–$C_6$ alkoxy and n is an integer of from 0 to 4. Specific examples of the above-mentioned compounds are: 3-(2'-hydroxy-4'-dimethylaminophenyl )-3-(2'[-methoxy-5'-chlorophenyl) phthalide, 3-(2'-hydroxy-4'-dimethylaminophenyl)-3-(2'-methoxy-5'-nitrophenyl-phthalide, 3-(2'-hydroxy-4'-diethylaminophenyl)-3-(2'-methoxy-5'-methylphenyl) phthalide, and 3-(2'-methoxy-4'-dimethylaminophenyl)-3-(2'-hydroxy-4'-chloro-5'-methylphenyl)-phthalide.

There are many substances which change the color of the dyes by oxidizing them and function as developers. Suitable color developers for the thermosensitive recording materials of this invention are phenol compounds, organic acids or metal salts thereof and hydroxybenzoic acid esters. Preferred color developers are phenol compounds and organic acids which melt at about 50° C. to 250° C. and are sparingly soluble in water. Examples of these phenol compounds include 4,4'-isopropylene-diphenol (bisphenol A), p-tert-butylphenol, 2-4-dinitrophenol, 3,4-dichlorophenol, p-phenylphenol, 4,4-cyclohexylidenediphenol. Useful examples of organic acid and metal salts thereof include 3-tert-butylsalicylic acid, 3,5-tert-butylsalicylic acid, 5-a-methylbenzylsalicylic acid and salts thereof of zinc, lead, aluminum, magnesium or nickel. Some other color developers are p-phenylphenol, 2,2-bis(4'-hydroxyphenyl)-n-heptane and 4,4'-cyclohexylidene phenol.

Sensitizers or thermosensitivity promoter agents give a good color density. The exact mechanism by which the sensitizer helps in the color forming reaction is not well known. It is generally believed that the sensitizer forms a eutectic compound with one or both of the color forming compounds. This brings down the melting point of these compounds and thus helps the color forming reaction to take place with ease at a considerably lower temperature. Some of the common sensitizers which are suitable are fatty acid amide compounds such as acetamide, stearic acid amide, linolenic acid amide, lauric acid amide, myristic acid amide, methylol compounds or the above mentioned fatty acid amides such as methylenebis (stearamide), and ethylenebis (stearamide), and compounds of p-hydroxybenzoic acid esters such as methyl p-hydroxybenzoate, n-propyl p-hydroxybenzoate, isopropyl p-hydroxybenzoate, benzyl p-hydroxybenzoate. The thermosensitive coating may contain other components such as resin binders and fillers.

The thermosensitive coatings used as base sheets can vary in composition, as is conventionally known in the art, including the encapsulation of components therein and the use of protective layers thereon to prevent premature coloration during handling. Such thermosensitive coatings can also be applied by conventional methods using conventional equipment. The base sheet of the print medium used can be in any conventional form such as rolls, separate sheets or fan fold sheet arrangements.

The print media of this invention contain at least one sense mark on a surface of the base sheet. Preferably, the print medium comprises multiple sense marks spaced at regular intervals. The marks are positioned so as to trigger an automated operation when identified by a logic element (circuit or apparatus). The marks have an area sufficient for a detector operating in the near infrared region of 650 nm to 2,500 nm to sense the mark therein. 2 Preferably, the mark comprises an area of from 0.125 inch to 1.0 inch . Most preferably, the mark is a rectangle having a length ranging from ½ inch to 1 inch and a width of from ⅛ inch to ½ inch.

The mark comprises a near infrared fluorescent (NIRF) compound which reflects and/or fluoresces near infrared radiation when illuminated with near infrared radiation. The concentration of NIRF compound within this mark is sufficient to increase the reflectance of near infrared radiation of the mark over the reflectance of near infrared radiation by the base sheet. Such a concentration can be achieved with a coating formulation comprising at least 0.5 ppm NIRF compound, applied with a flexographic press. Low concentrations of NIRF compound can be used effectively with NIRF dyes. The concentration of NIRF compound within the NIRF dyes preferably ranges from about 0.01 ppm to 1000 ppm. Preferred concentrations of NIRF compound are those derived from coating formulations of NIRF pigments comprising 0.5 to 300 ppm NIRF, based on total solids.

The contrast in reflecting near infrared radiation between the mark and base sheet must be sufficiently high such that the mark can be sensed by a detector operating in the near infrared region such that the location of the mark on the base substrate is identified by a logic apparatus operating on a signal from the detector. Preferably, the detected near infrared radiation is converted to a voltage by the detector, such as a photon detector, and the mark provides a voltage of at least 0.1 volts greater than the base substrate. Preferably, the voltage differential is about 0.2 volts. The mark can be printed on either side of the base sheet for detection and is preferably positioned on the unprinted side or along the edge of the printed side of the base sheet.

Suitable NIRF compounds can be employed as a pigment or dye. NIRF dyes comprise NIRF compounds in solution, preferably in aqueous solutions. The NIRF pigments are solids and are comprised of polymer or copolymer which is either admixed with NIRF compounds or the NIRF compounds are copolymerized with other active monomers, oligomers or polymers to form a copolymer. The active monomers, oligomers of polymers typically have at least one reactive group selected from the formulae $$—OCOR_{14}, —OCO_2R_{14}, OCONHR_{14} \text{ or } —CO_2R_{14},$$

wherein $R_{14}$ is selected from unsubstituted or substituted alkyl, cycloalkyl or aryl radicals. $R_{14}$ preferably is unsubstituted alkyl, e.g., alkyl of up to about 8 carbons, or phenyl, and most preferably lower alkyl, e.g., methyl and ethyl. The reactive group preferably is hydroxy, carboxy, carbomethoxy, carboethoxy or acetoxy. The active monomers, oligomers and polymers contain 1 to about 8 reactive groups, preferably 2 in the case of monomers or oligomers. Preferred polymers may contain more. The NIRF compounds are added at such low levels that they do not significantly alter the polycondensation reaction of these active species.

The monomers, oligomers or polymers admixed or copolymerized with NIRF compounds to form NIRF pigments are preferably insoluble in water, such as polyesters, polycarbonates and polyurethane and are used in an amount sufficient to render the NIRF pigments waterproof.

The diol components of the polyester may be comprised of, for example, ethylene glycol, 1,4-cyclohexanedimethanol, 1,2-propanediol, 1,3-propanediol, 2-methyl-, 1,3-propanediol, 1,6-hexanediol, 1,2-cyclohexanediol, 1,4-cyclohexanediol, 1,10-decanediol, 1,2-cyclohexanedimethanol, 1,3-cyclohexanedimethanol, X,8-bis-(hydroxymethyl)-tricyclo-[5.2. 1.0]-decane wherein X represents 3, 4, or 5; and diols containing one or more oxygen atoms in the chain, e.g., diethylene glycol, triethylene glycol, dipropylene glycol or tripropylene glycol and the like. In general, these diols contain 2 to 18, preferably 2 to 12 carbon atoms. Cycloaliphatic diols can be employed in their cis or trans configuration or as a mixture of both forms.

The acid components (aliphatic, alicyclic, or aromatic dicarboxylic acids) of the polyester may be comprised of, e.g., terephthalic acid, naphthalene-2,6-dicarboxylic acid, isophthalic acid, 1,4-cyclohexanedicarboxylic acid, 1,3-cyclohexane dicarboxylic acid, succinic acid, glutaric acid, adipic acid, sebacic acid, 1,12-dodecanedioic acid and the like. In place of the dicarboxylic acids themselves, it is possible and often preferable to use a functional acid derivative thereof such as the dimethyl, diethyl or dipropyl ester of the dicarboxylic acid. The anhydrides of the dicarboxylic acids can likewise be employed. The polyesters can be produced using typical polycondensation techniques well known in the art. Polycarbonates useful in the practice of the invention are disclosed in *Kirk-Othmer Encyclopedia of Chemical Technology*, third edition, Vol. 18, pp. 479–494.

A wide range of thermoplastic resins suitable for blending with the above condensation copolymers which contain the NIRF compounds are known in the art and include polyesters, e.g., poly(ethylene terephthalate) and poly (butylene terephthalate); polyolefins, e.g., polypropylene, polyethylene, linear low density polyethylene, polybutylene and copolymers made from ethylene, propylene and/or butylene; polyamides, e.g., nylon 6 and nylon 66; polyvinyl chloride, polyvinylidene chloride; polycarbonates; cellulose esters, e.g., cellulose acetate, propionate, butyrate or mixed esters; polyacrylates, e.g., poly(methyl methacrylate); polyimides; polyester-amides; polystyrene; and ABS (acrylonitrile-butadiene-styrene)type polymers.

The level of NIRF compounds present in the admixture or copolymer of NIRF pigment can vary considerably; although, it is generally desirable that the NIRF compound be present at the lowest practical level needed to produce a satisfactory fluorescence detection level to minimize costs. NIRF compounds are typically added in an amount of from 0.5 ppm to about 1000 ppm of the pigment, with about 1 ppm to about 300 ppm being preferred.

The NIRF compounds within the mark are shielded from oxygen in ambient air, preferably by a polymer resin which limits contact of the NIRF compound with air. Where a NIRF dye is used, a layer of these compounds must be overcoated with a polymer resin. The mark employed on thermal paper may be positioned underneath the thermosensitive coating to further shield the NIRF compounds from contact with ambient oxygen. Where the NIRF pigments are used, the NIRF compounds are shielded by the polymers admixed or copolymerized therewith.

The NIRF compounds employed in the marks are responsive to wavelengths in the near infrared region of 650 nm to 2,500 nm. The NIRF compounds need not absorb or transmit light under ambient conditions, i.e., they can be transparent or invisible to the naked eye under such conditions and are preferably so. Preferred compounds have excellent thermal stability and little light absorption in the visible light region, i.e., they impart little or no color to the base sheet and have strong absorption of near infrared light (high molar extinction coefficients) and strong fluorescence in the near infrared region over the wavelengths of about 780 nm to 2,500 nm. An example of a preferred NIRF pigment is NIRF 2300 from Eastman Chemical, which absorbs and reflects near infrared radiation at a wavelength of about 780 nm. They are preferably stable to sunlight and fluorescent light.

Suitable NIRF compounds are those disclosed in U.S. Pat. Nos. 5,292,855, 5,422,432 and 5,336,714. The NIRF compound employed may depend on the equipment used to apply the NIRF compound to the base sheet. Examples of suitable NIRF compounds are selected from the classes of phthalocyanines, naphthalocyanines and squaraines that correspond to Formulae II, III and IV:

(IV)

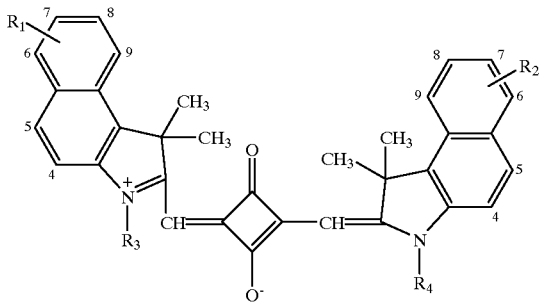

wherein Pc and Nc represent the phthalocyanine and 2,3-naphthalocyanine moieties of Formulae IIa and IIIa, IIa

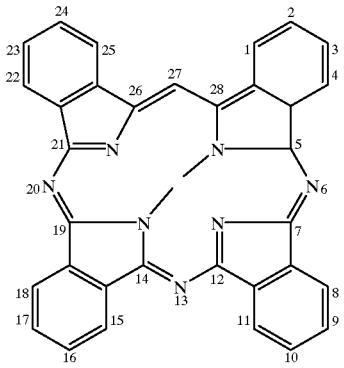

IIIa

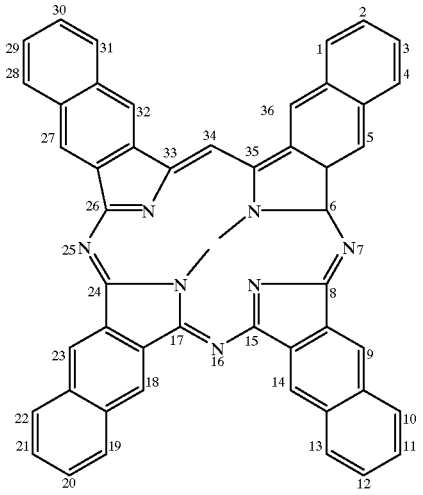

respectively, covalently bonded to various halometals, organometallic groups, and oxymetals, preferably aluminum and silicon based, including AlCl, AlBr, AlF, $AlOR_5$, $AlSR_5$, $SiCl_2$, $SiF_2$, $Si(OR_6)_2$, $Si(SR_6)_2$.

$R_5$ and $R_6$ of these aluminum and silicon based groups are selected from hydrogen, alkyl, aryl, heteroaryl, lower alkanoyl, arylcarbonyl, arylaminocarbonyl, trifluoroacetyl, groups of the formulae

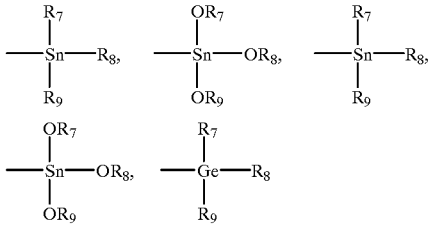

or

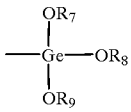

$R_7$, $R_8$ and $R_9$ of these Sn and Ge groups are independently selected from alkyl, phenyl or phenyl substituted with lower alkyl, lower alkoxy or halogen.

X of formulae II and III is selected from oxygen, sulfur, selenium, tellurium or a group of the formula $N—R_{10}$, wherein $R_{10}$ is hydrogen, cycloalkyl, alkyl, acyl, alkylsulfonyl, or aryl or $R_{10}$ and R taken together form an aliphatic or aromatic ring with the nitrogen atom to which they are attached.

Y of formulae II and III is selected from alkyl, aryl, heteroaryl, halogen or hydrogen.

R of formulae II and III is selected from hydrogen, unsubstituted or substituted alkyl, alkenyl, alkynyl, $C_3$–$C_8$ cycloalkyl, aryl, heteroaryl, alkylene,

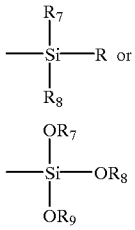

Alternatively, $—(X—R)_m$ is one or more groups selected from alkylsulfonylamino, arylsulfonylamino, or a group selected from the formulae $—X(C_2H_4O)_zR$, wherein R is as defined above and Z is an integer of from 1–4;

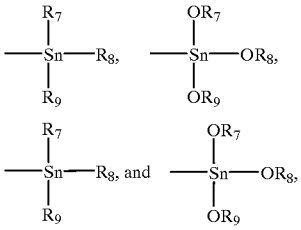

In addition, two $—(X—R)_m$ groups can be taken together to form divalent substituents of the formula

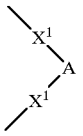

wherein each $X^1$ is independently selected from —O—, —S—or —N—$R_{10}$ and A is selected from ethylene, propylene, trimethylene, and such groups substituted with $C_1$–$C_4$ alkyl, $C_1$–$C_4$ alkoxy, aryl and cycloalkyl, 1,2-phenylene and 1,2-phenylene containing 1–3 substituents selected from $C_3$–$C_4$ alkyl, $C_1$–$C_4$ alkoxy or halogen.

For formulae II and III, n is an integer from 0–16; $n_1$ is an integer from 0–24, m is an integer from 0–16 and $m_1$ is an integer from 0–24, provided that the sums of n+m and $n_1+m_1$ are 16 and 24, respectively.

$R_1$ and $R_2$ of formula IV are independently selected from hydrogen, lower alkyl, lower alkoxy, halogen, alyloxy, lower alkylthio, arylthio, lower alkylsulfonyl; arylsulfonyl; lower alkylsulfonylamino, arylsulfonylamino, cycloalkylsulfonylamino, carboxy, unsubstituted and substituted carbamoyl and sulfamoyl, lower alkoxycarbonyl, hydroxy, lower alkanoyloxy,

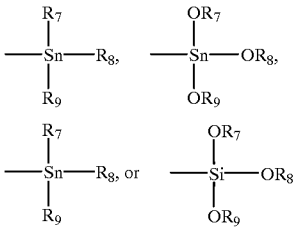

$R_3$ and $R_4$ of formula IV are independently selected from hydrogen, lower alkyl, alkenyl or aryl.

The NIRF compounds of formulae II, III and IV above can be prepared by conventional methods. In the above formulae, the phthalocyanine and naphthalocyanine compounds of formulae IIa and IIIa may also be covalently bonded to a hydrogen, AlOH, Ca, CO, CrF, Cu, Fe, Ni, Ga, Mg, Mn, Pb, Pt, Pd, $SnCl_2$, Sn, $Si(OR)_2$, TiO, Zn and others, as described in U.S. Ser. No. 789,570, filed Nov. 8, 1991, which is a grandparent application of U.S. Pat. No. 5,461,136.

Preferably, m is from 4–12 and ml is from 0–8 for formulae II and III. Other preferred compounds include the squaraine compounds of formula IV, wherein $R_1$ and $R_2$ are independently carboxy or lower alkoxy carbonyl; a 2,3-naphthalocyanine compound of formula III, wherein Y is hydrogen, $n_1$ is 24, and $m_1$ is 0; a 2,3-naphthalocyanine compound of formula III, wherein the naphthalocyanine moiety is bonded to $SiCl_2$, $Si(OH)_2$, or $Si(OR_6)_2$; and a phthalocyanine compound of formula II, wherein X is oxygen, R is aryl, Y is hydrogen, m is 4, and n is 12; and wherein the phthalocyanine moiety is bonded to AlCl, AlOH, $AlOCOCF_3$, $AlOR_5$, $SiCl_2$, $Si(OH)_2$, or $Si(OR_6)_2$.

Examples 1–41 of U.S. Pat. No. 5,461,136 are incorporated by reference for the description of the preparation of copolymers for NIRF pigments therein.

The concentration of NIRF compound within the coating formulations used to prepare the print media can vary over wide limits. In general, coating formulations can provide an optical effect with concentrations as low as about 0.01 ppm, typically within the range of 0.5 ppm to 1000 ppm, and preferably 1 to 300 ppm, based on the dry components of the coating formulation. Such small amounts are sufficient to impart fluorescence capable of detection. These coating formulations can be applied by conventional equipment such as flexographic press provided by Wolverine and Mark Andy.

With flexographic printing, the solids content of the ink is preferably about 50 wt. %, i.e., from about 40–60 wt. %, for NIRF pigments, a significant portion of which comprises the carrier polymers or copolymers which contain the NIRF compounds.

The coating formulation used to prepare the marks of the print medium of present invention may be obtained from concentrates of NIRF compounds. These concentrates typically comprise 0.1–30.0 wt. % NIRF compound, preferably 0.1 to about 10 wt. % NIRF compound. The concentrate is used as a powder or pellet admixed with the desired polyester or other thermoplastic polymer to form the final pigment. The concentrate may be dried and/or solution blended.

The NIRF pigment particles may contain additional components to enhance or add to their performance. For example, fluorescent pigments and photochromic compounds which change color when exposed to UV light can be used. Suitable photochromic compounds include the spiro compounds of formula V disclosed by Takashi et al. in U.S. Pat. No. 5,266,447. These include spiroxazine compounds, spiropyran compounds and thiopyran compounds of the formulae in columns 5–6 of U.S. Pat. No. 5,266,447. Other examples of suitable photochromic compounds include the benzopyran compound disclosed by Kumar in U.S. Pat. No. 5,429,774, the benzothioxanthone oxides disclosed by Fischer et al. in U.S. Pat. No. 5,177,218, the dinitrated spiropyrans disclosed by Hibino et al. in U.S. Pat. No. 5,155,230, the naphthacenequinones disclosed by Fischer et al. in U.S. Pat. No. 5,206,395 and U.S. Pat. No. 5,384,077, the spiro(indoline) naphthoxazine compounds disclosed by VanGemert in U.S. Pat. No. 5,405,958, the ring compounds disclosed by Tanaka et al. in U.S. Pat. No. 5,106,988 and the spiro-benzoxazine compounds disclosed by Rickwood et al. in U.S. Pat. No. 5,446,151. Mixtures of such compounds are preferred and are available commercially from sources such as Color Change Corp. of Schaumburg, Ill. and Xytronyx Inc. of San Diego, Calif.

The pigments may also contain additional resins or waxes, as well as UV stabilizers to enhance performance. The NIRF pigments may also be applied with a binder which binds the pigments to the surface of the base sheet. The binders may comprise resin, wax or a combination thereof. The binder employed will depend on the method of applying the sense mark, i.e., either ink jet, flexographic, electrostatic or thermal transfer printing. For flexographic printing, it is preferable that any binder used be water soluble, dispersible or emulsifiable. The amount of binder employed will also depend on the method used to deposit the NIRF pigment.

The coating formulations containing NIRF dyes or NIRF pigments preferably comprise an aqueous based carrier so as not to pre-activate the thermosensitive layer. The carrier can comprise an aqueous solution with or without a water soluble, dispersible or emulsifiable organic solvent which does not activate the thermal paper. The aqueous based carrier may contain a dispersing agent to help solubilize the NIRF pigment or dye within the security ink. The security ink is preferably dried on the thermal paper by the evaporation of water and any other volatile components within the aqueous based carrier to leave a solid layer. The binder compounds of the carrier and the amount thereof can vary widely, depending on the method intended to be employed for depositing the security ink on the base layer. For example, the amount of water used can vary from 1 to 70 wt. % based on the total weight of the security ink containing the NIRF dye or pigment.

The water based coating formulations used to form the NIRF sense marks on the thermal papers of this invention may comprise a water emulsifiable or dispersible wax and/or a water soluble, emulsifiable or dispersible thermoplastic resin binder component. The waxes can be natural waxes, including Carnauba wax, candelilla wax, beeswax, rice bran wax, petroleum waxes such as paraffin wax, synthetic hydrocarbon waxes such as low molecular weight polyethylene and Fisher-Tropsch wax, higher fatty acids such as myristic acid, palmitic acid, stearic acid and behenic acid; higher aliphatic alcohols such as steryl alcohol and esters such as sucrose fatty acid esters. Mixtures of waxes can also be used. To aid in the dispersion of the wax within an aqueous medium, micronized grades of wax are preferred.

Water soluble, dispersible or emulsifiable resins suitable as binders include thermoplastic resins such as polyvinyl chloride, polyvinyl acetate, vinyl chloride-vinyl acetate copolymers, polyethylene, polypropylene, polyacetal, ethylene-vinyl acetate copolymer, ethylenealkyl(meth) acrylate copolymer, ethylene-ethylacetate copolymer, polystyrene, styrene copolymers, polyamide, ethylcellulose, epoxy resin, polyketone resin, polyurethane resin, polyvinylbutryl, styrenebutadiene rubber, nitrile rubber, acrylic rubber, ethylene-propylene rubber, ethylene alkyl (meth)acrylate copolymer, styrene-alkyl(meth)acrylate copolymer, acrylic acid-ethylene-vinylacetate terpolymer, saturated polyesters and sucrose benzoate. To obtain emulsions of polymers which are insoluble or partially soluble in water, the resin is typically ground to submicron size.

The binders may comprise a blend of resins to provide a specific property profile. The amount of thermoplastic resin can range from 15–35 wt. %, and preferably comprises at least 25 wt. % of the coating formulation, based on the total dry ingredients.

The mark on the print media of the present invention can be applied by conventional methods such as impact printing, ink jet printing, thermal transfer printing, flexographic printing, electrostatic printing, relief printing, offset printing, lithography and silk screening. Once the coating formulation is applied, it is typically dried at temperatures less than 65 C, preferably at ambient temperature. The thermal papers of the present invention which contain a NIRF sense mark can also be prepared by conventional means which do not require the application of heat or high temperatures. Examples include flexographic printing, relief printing, offset printing, lithography and silkscreening. Once the coating formulation is applied, it is preferably dried at ambient temperature, so as not to discolor the paper.

The sense mark on the print media of the present invention is positioned to trigger an automatic operation when identified by a logic apparatus/circuit. The detection equipment employed for such purpose is conventional and well known. The automatic operation which is triggered can vary widely and can include printing, advancing, stopping, counting, cutting, or other paper handling procedure.

The NIRF compounds on the print media must be stable to be effective as a sense mark. Preferably, the NIRF compounds remain sufficient stable so as to be sensed by a detector and identified by a logic apparatus at least 60 days from manufacture. Preferably, the NIRF compounds remain stable for one year or more. It is also preferable that the mark remain transparent to the naked human eye under illumination with a 60 watt incandescent light bulb. It should be noted that the mark on the printed media claimed herein may contain an additional sensible material selected form the group consisting of colored dyes, and pigments which do not absorb near infrared radiation, fluorescent dyes, fluorescent pigments, photochromic dyes and photochromic pigments which absorb and reflect light upon exposure to UV light. The NIRF compound and its carrier should not cause prereaction of the thermosensitive coating.

The paper dispensing apparatus provided by the present invention comprises a print medium of the present invention as described above, a detector which senses the mark on the print medium and sends a signal to a logic element which locates the mark on the print medium based signals from the detector and an automated paper handling device which is controlled by the logic element. A preferred embodiment includes a printing apparatus adapted to print on the print medium.

FIG. 1 shows an example of a paper dispensing apparatus of this invention with a print medium 10 positioned on detector 30. The detector 30 comprises a light source 25 which emits near infrared radiation, that impinges surface 35 of print medium 10 through glass window 40. The detector also comprises receiver 26, which converts near infrared radiation reflected from surface 35 of print medium 10, preferably through glass window 40 to a signal, such as a voltage on leads 27 and 28. This signal is processed by logic element 45 which locates NIRF marks on said print medium based on the output signals from detector 30. Logic element 45 operates paper handling device 50, preferably via leads 31 and 32, based on these signals.

Although not required, preferred embodiments include concentrating element 14 which focuses light emitted from the light source 25 on print medium 10 and near infrared light reflected from print medium 10 may also be focused on receiver 26 by concentrating element 24. The paper handling device 50 can be incorporated or integrated in a printing apparatus, such as a dot matrix printer, thermal transfer printer, ink jet printer or thermal printer. The paper handling device typically is an automatic document feed adapted to dispense printed paper media such as tickets and receipts or it may comprise a cutting apparatus adapted to cut separate sheets from a continuous roll or printing apparatus for printing on the print media. While the apparatus of FIG. 1 shows a single light source and receiver, it is recognized that multiple units may be employed where desired. Examples of suitable light sources include light emitting diodes. Suitable receivers include photodiodes and phototransistors adapted to provide a voltage when impinged by near infrared radiation. Such photodiodes/phototransistors are conventional and, where necessary, a filter element may be used to limit visible light from impinging the receiver. The receiver 26 is preferably shielded and spaced from the light source 25 to provide effective operation of the detector. Preferably reflective elements 16 are used to accomplish this, as in the embodiment of FIG. 1. However, spacing cannot be so far as to miss the fluorescent emissions of the NIRF compound. In preferred embodiments, the light source is separated from the photodiode by a reflecting layer disposed therebetween.

The area illuminated on said print medium preferably ranges from 10% to 200% of the area of the mark on said print medium. Similarly, the area from which NIRF radiation is detected is preferably from 10% to 200% of the area of the sense mark. Larger areas make it difficult to locate the position of the mark.

The logic elements (circuit/apparatus) suitable for use in this invention are conventional. For example, the logic elements used with black sense marks are suitable, where they are adjusted to respond to the voltage or signal from receiver operating in the near infrared region. The configuration of the light source and receiver (photodiode) may conform to those used in detecting black sense marks. However, spacing between the imaging area and detecting area may be adjusted depending on the contrast achieved between marked surfaces and unmarked surfaces. Although not desired, to enhance contrast, the NIRF sense mark may be bordered by a near infrared absorbing material.

FIG. 2 illustrates a comparison of a preferred illuminated area 100 and detecting area 200 relative to the area of mark 300.

The logic element may be adjusted to accommodate signals from the detector using a NIRF pigment as compared to a black pigment. Fluorescence through the base sheet by the NIRF pigments may result in detection of the mark in advance and subsequent to actual positioning of the mark over the sensing area depending on the composition of the base sheet. The logic element can be programmed or designed to accommodate these readings in locating the mark. The paper dispensing apparatus of the present invention preferably includes a printer as discussed above. Most preferably, the apparatus is adapted for use in automatic teller machines, cash registers and ticket dispensing apparatus.

Preferably the apparatus may be adjusted with respect to the size of the mark on the print media, the size of the detection area and the size of the imaging area, depending on the NIRF compound used. Certain NIRF compounds may differentiate the base substrate from the marked area better than others, depending on the compositions of the base substrates. For example, NIRF compounds which emit at 780 nm provide greater contrast with a thermal paper base substrate than NIRF compounds fluorescing at 670 nm (NIRF 2200 by Eastman Chemical).

The entire disclosure of all applications, patents and publications, cited above and below, are hereby incorporated by reference.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

EXAMPLE

Example 1

Preparation of Concentrate

Figure 1:
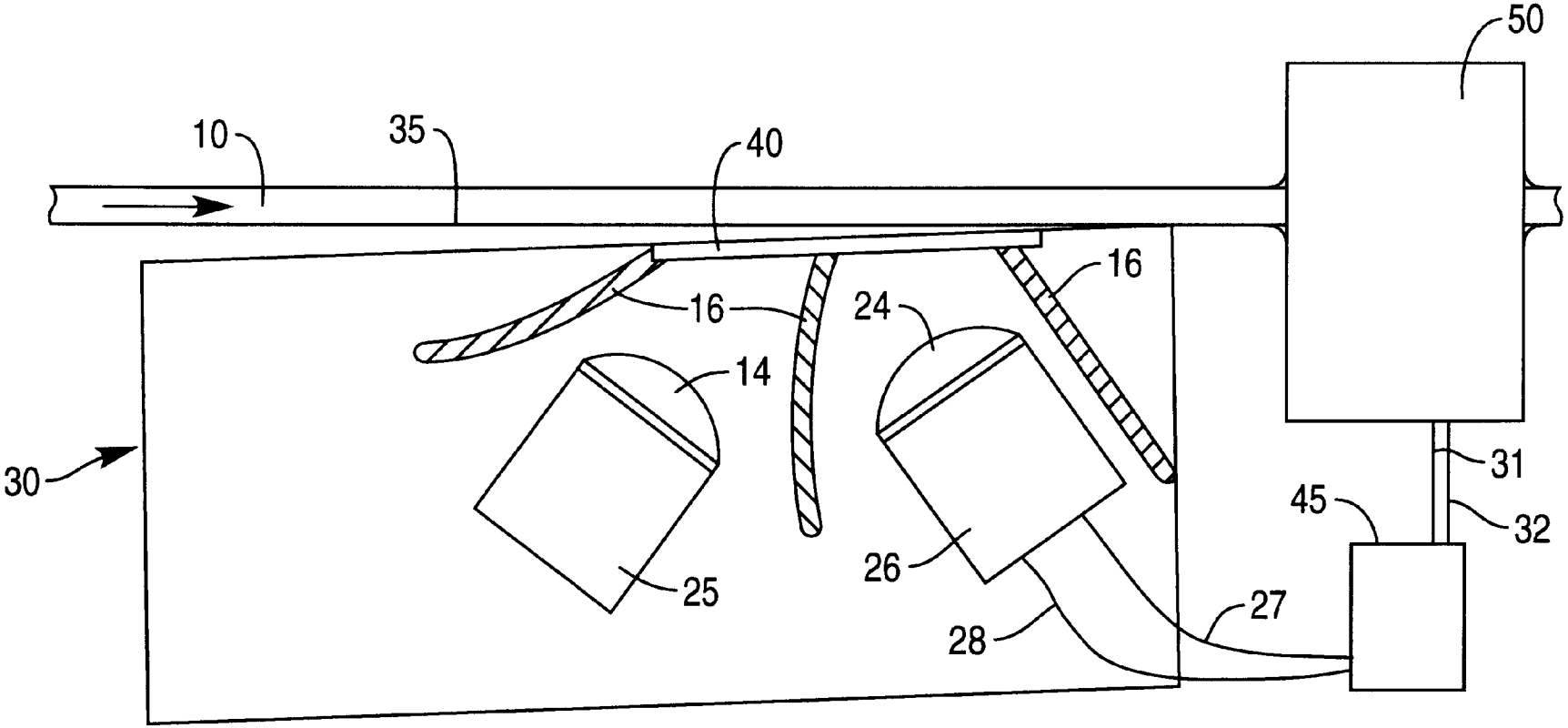
FIG. 1 illustrates a detector of an automatic paper dispensing apparatus of the present invention.
Figure 2:
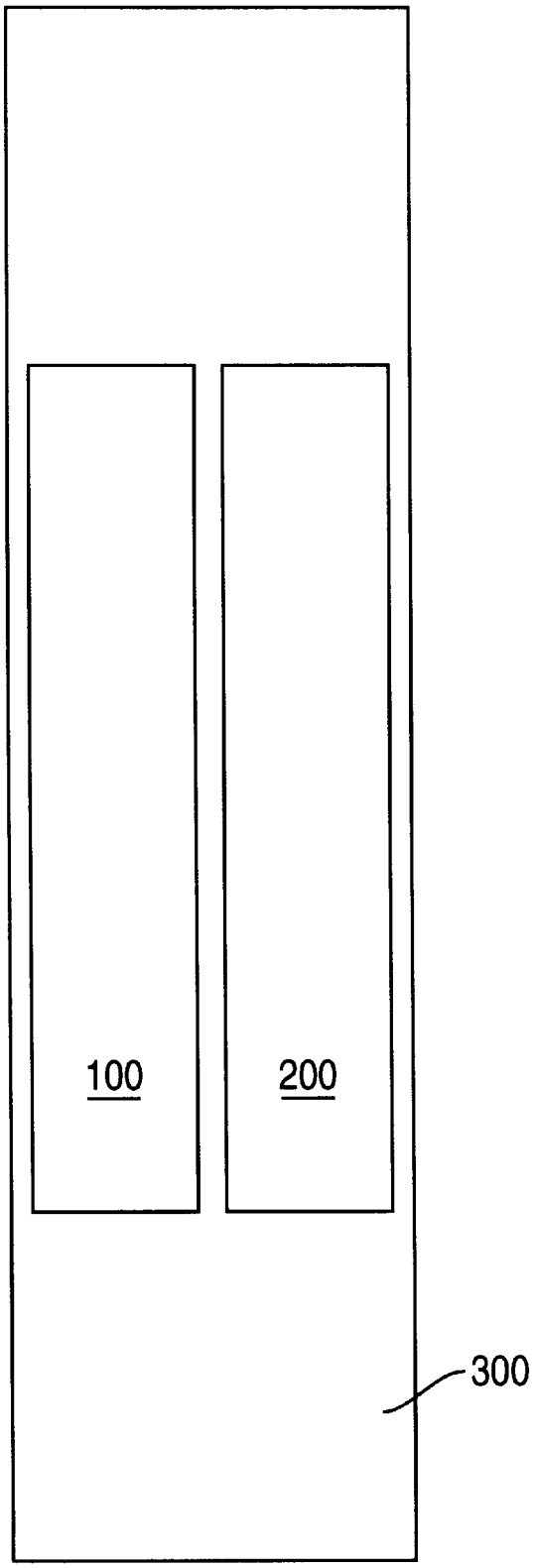
FIG. 2 is a representation of the viewing area, imaging area and printed area of a sense mark on a printed medium of the present invention.

A NIRF pigment concentrate was prepared by dispersing Eastek 1100 polyester, available from Eastman Chemical, with 2000 ppm NIRF 670 in its backbone in deionized water at a concentration of 30 wt. % solids. The concentrate comprises 600 ppm NIRF 670 dye compound.

Coating formulations were prepared using the 600 ppm concentrate of NIRF 670 dye compound and the flexo-overprint varnish—X24561-115C, 75/25 of Eastek 1100/1300, as a diluent. Coating formulations with 30, 60 and 120 ppm concentrations of NIRF 670 were prepared. The viscosity of the coating formulations was about 19 seconds of Zahn cup No. 2.

Printing on Thermal Paper

Samples of thermal paper, Konzaki F-380, having a thermosensitive coating thereon, are printed with marks from coating formulations under the following eight different conditions:

1. print 60 ppm ink on the back side of thermal paper without using heat drying;
2. print 60 ppm ink on the front side of thermal paper without using heat drying;
3. print 60 ppm ink on the back side of thermal paper with heat drying;
4. print 60 ppm ink on the front side of thermal paper with heat drying;
5. print 30 ppm ink on the back side of thermal paper with heat drying;
6. print 120 ppm ink on the back side of thermal paper with heat drying;
7. print 30 ppm ink on the front side of thermal paper with heat drying;
8. print 120 ppm ink on the front side of thermal paper with heat drying.

The marks are printed using a Mark Andy 830 Flexo press. The marks are rectangular (1 inch×½ inch) printed at 6 inch intervals. The marks are also invisible to the naked human eye under ambient indoor conditions. A rubber metering roll is used to supply and meter the coating formulations into an Anilox roll from which the coating formulation is transferred to the substrate through a plate. The Anilox roll comprises 200 pyramids with a volume of 7 BCM. The line speed is 250 ft/min. Drying without heat is accomplished by exposure to air without blowing air. Drying with heat is accomplished using a Quartz lamp as a heat source with blowing air at a temperature of about 110° F. in the dryer zone.

Sensing Test

While drying, the prints are tested for detection of the NIRF pigments using a Meter Model DM-8 detector by V.C. Engineering Inc. of Cincinnati, Ohio. Prints of tests 1 and 2 can be detected easily on the press during the run using the detector. However, the prints of test 1 are not detectable when one sheet of printed sample is placed on a light-gray table. The prints of test 2 are still detectable when placed on a light-gray table. This indicates the coating formulation forms a better film on the front side of the paper having a higher smoothness (20 Sheffield smoothness vs. 70 for back side).

Prints of tests 3 and 4 are both detectable during the run and when laid on a light-gray table. Prints of tests 6 and 8 are also detectable. The heat drying process produced papers with stronger signals, as observed using a Sony CCD camera. However, the heat drying seems to reduce the amount of NIRF compound penetrating the pores of paper.

Prints 5 and 7 are scannable on the light-gray table, but are not detectable on the press run, indicating 30 ppm concentration of NIRF 670 compound is not preferred for production. The detectable amounts thereof could depend on line speed of the production line. The above test results show there is no short-term effect of the thermal coating on the effectiveness of the NIRF compound.

Example 2

Coating formulations of NIRF T4 780 at concentrations of 300 and 600 ppm are prepared using 3000 ppm and 6000 ppm NIRF concentration polymers, respectively. The NIRF T4 pigments are dispersed into acrylic overprint varnish and the solids adjusted to 44% in water. The viscosity of both coating formulations is 23 seconds in a Zahn Cup #2 (X24429-187 and X24429-188B).

Printing on Thermal Paper

The two coating formulations are printed on rolls of Kanzaki F-380 thermal paper and No. 15 bond paper, respectively, using a Mark Andy 830 Flexo press to provide marks, as discussed above in Example 1. A rubber metering roll is used to supply and meter ink to an Anilox roll, from which the ink is transferred to a rubber plate. The Anilox roll comprises ceramic 300 lines (10 BCM) and 400 lines (7 BCM) Anilox rolls, respectively. The line speed is 100 feet per minute and drying is accomplished employing a quartz lamp as a heat source. The NIRF compound is detected on the papers both during and after the press run with the detector described in Example 1. The detector sends signals to a logic element programmed to initiate a paper cutter. Six inch sheets were cut with the detection of each mark.

Example 3

Coating formulations described in Examples 1 and 2 (NIRF 670 and NIRF T4 780) are coated on various types of paper, both front and back with the Marc Andy Flexo press discussed above with an Anilox roller 300 with 10 BCM rollers. The coating formulations are printed on the following papers at a press speed of 200 feet per minute, as 2" wide strips traveling with the web at a length of 14".

1. 3-S tablet
2. T-1012A and
3. Enviro 100,

The NIRF compounds on each paper were sensed during printing using the detector described in Example 1.

Example 4

Two sets of five colors bars (¾" tall and 13" wide) are applied to the various papers of Example 3, as set forth below.

Set #1 1. Pantone Green
2. Pantone Black
3. Pantone Cyan
4. Pantone Violet
5. PMS 348

Set#2 1. Reflex Blue
2. PMS 185
3. PMS 347
4. PMS 469
5. PMS 165.

The security inks described in Examples 1 and 2 are applied (Groups 1 and 2) as shown in Table A and NIRF compound was detected in each.

| NIRF Position | Paper | Color Group |
|---|---|---|
| 1. Front | 3-S | 1 |
| 2. Back | 3-S | 1 |
| 3. Front | T-1012 | 1 |
| 4. Back | T-1012 | 1 |
| 5. Back | E-100 | 1 |
| 6. Front | E-100 | 1 |
| 7. Back | 3-S | 2 |

-continued

| NIRF Position | Paper | Color Group |
|---|---|---|
| 8. Front | 3-S | 2 |
| 9. Back | T-1012 | 2 |
| 10. Back | T-1012 | 2 |
| 11. Front | E-100 | 2 |
| 12. Back | E-100 | 2 |

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A medium for printing which comprises a base sheet and at least one mark on the surface of said base sheet positioned to trigger an automatic operation when identified by a logic element, said mark comprising:

a) a near infrared-fluorescence (NIRF) compound which reflects near infrared radiation when illuminated with near infrared radiation, the concentration of said NIRF compound in said mark is sufficient to increase the reflectance of near infrared radiation of said mark above that of said base sheet; and b) a polymer resin which limits contact of the NIRF compound with air, wherein said mark is transparent or invisible to the naked eye and the contrast in reflecting near infrared radiation between said mark and said base sheet are sufficient such that the mark can be sensed by a detector operating in the near infrared region of 670 nm to 2500 nm and the location of the mark can be identified by a logic element by one or more signals from the detector.

2. A print medium as in claim 1, wherein the mark is positioned to initiate an automated paper transport operation of an apparatus for automatically dispensing printed media when sensed by said detector and located by a logic element of said apparatus.

3. A print medium as in claim 1, wherein the NIRF compound is sufficiently stable in air so as to he sensed by said detector over 60 days after it is applied to a base sheet.

4. A print medium as in claim 1, wherein the mark is transparent to the naked human eye under illumination with a 60 watt incandescent light bulb.

5. A print medium as in claim 4, wherein the mark comprises a NIRF pigment with 100–1000 ppm NIRF compound and comprises an area of 0.125 to 1.0 inch$^2$.

6. A print medium as in claim 1, wherein said NIRF compound is selected from the group consisting of phthalocyanines, naphthalocyanines and squaraines.

7. A print medium as in claim 1, wherein the base sheet comprises a continuous sheet of paper and the marks are located on an edge of said continuous sheet of paper.

8. A print medium as in claim 1, wherein the polymer resin which limits contact of the NIRF compound with air is a polymer layer positioned over the NIRF component.

9. A print medium as in claim 1, wherein the polymer resin which limits contact of the NIRF compound with air is a copolymer with a NIRF compound on the backbone thereof, wherein said copolymer components are selected from the group consisting of monomers and oligomers which form polyester, polycarbonate and polyurethane polymers.

10. A print medium as in claim 1, wherein the polymer resin which limits contact of the NIRF compound with air is a carrier polymer with the NIRF compound dispersed therein, wherein said carrier polymer is selected from the group consisting of polyesters, polycarbonates and polyurethanes.

11. A print medium as in claim 1, wherein the mark contains an additional sensible material selected form the group consisting of colored dyes and pigments which do not absorb near infrared radiation, fluorescent dyes and pigments which absorb and reflect light upon exposure to UV light and photochromic dyes and pigments which absorb and reflect light upon exposure to UV light.

12. A print medium as in claim 1, wherein the base sheet is a thermal paper.

13. A print medium as in claim 12, wherein the NIRF compound absorbs and reflects light at 780 nm and above.

14. A print medium as in claim 12, wherein the thermal paper comprises a thermosensitive coating with reactive components that comprise a dye developer system, wherein the dye is a leuco dye and the developer is selected from the phenols or acidic materials.

15. A print medium as in claim 1, wherein the concentration of NIRF compound in the mark is sufficiently high to permit printing over the mark.

16. A print medium as in claim 1, wherein the NIRF compound is incorporated within a polymer backbone selected from polyesters, polycarbonates and polyurethanes in an amount of at least 0.1 wt. % of said polymer.

17. An apparatus for automatic dispensing of printed media which comprises:

a) a print medium as in claim 1 which comprises:

i) a base sheet and at least one mark on the surface of said base sheet positioned to trigger an automatic operation when identified by a logic element, said mark comprising a near infrared-fluorescence (NIRF) compound which reflects near infrared radiation when illuminated with near infrared radiation, the concentration of said NIRF compound in said mark is sufficient to increase the reflectance of near infrared radiation of said mark above that of said base sheet; and ii) a polymer resin which limits contact of the NIRF compound with air, wherein said mark is transparent or invisible to the naked eye and the contrast in reflecting near infrared radiation between said mark and said base sheet are sufficient such that the mark can be sensed by a detector operating in the near infrared region of 670 nm to 2500 nm and the location of the mark can be identified by a logic element by one or more signals from the detector;

b) a detector operating in the near infrared region of 670 nm to 2500 nm for sensing the mark on said print medium and generating one or more signals when a mark is sensed;

c) a logic element for locating the mark on said print medium based on one or more signals received from said detector; and d) a paper transporting apparatus controlled by said logic element.

18. An apparatus as in claim 17 which additionally comprises a printing apparatus for printing text, images or both on said print medium.

19. An apparatus as in claim 18, wherein the paper transporting apparatus advances, cuts, prints or performs a combination of these operations.

20. An apparatus as in claim 19, wherein the detector comprises a light source which emits near infrared radiation selected from the group consisting of light emitting diodes and silicon phototransistors.

21. An apparatus as in claim 20, wherein the detector comprises a receiver selected from the group consisting of photodiodes.

22. An apparatus as in claim 21, wherein the printing apparatus is a dot matrix printer, thermal printer, thermal transfer printer or ink jet printer.

23. An apparatus as in claim 22, adapted to detect near infrared radiation having a wavelength of 780 nm and above.

24. An apparatus as in claim 23, wherein the mark on said print medium comprises an area of 0.1 $in^2$ to 1 $in^2$.

25. An apparatus as in claim 24, wherein the mark sensing apparatus illuminates an area of the print medium in an amount of 10–200% of area for said mark and the sensing area of the print medium ranges from 10–200% above the area for said mark.

26. An apparatus as in claim 17 incorporated within a business machine selected for the group consisting of automatic teller machines, automatic ticket dispensers, cash registers, and automatic coupon dispensers.

27. An apparatus as in claim 26, wherein the concentration of NIRF compound on the print medium is sufficient to permit printing over the mark on said print medium.

* * * * *